United States Patent [19]

Shelton

[11] 4,163,918

[45] Aug. 7, 1979

[54] ELECTRON BEAM FORMING DEVICE

[76] Inventor: Joe Shelton, 700 Tatom St., NW., Huntsville, Ala. 35805

[21] Appl. No.: 864,348

[22] Filed: Dec. 27, 1977

[51] Int. Cl.[2] ..... H01J 1/02

[52] U.S. Cl. ..... 313/309; 313/351

[58] Field of Search ..... 313/309, 336, 351, 302

[56] References Cited

U.S. PATENT DOCUMENTS

| | | | |
|---|---|---|---|
| 3,745,402 | 7/1973 | Shelton et al. | 313/336 X |
| 3,783,325 | 1/1974 | Shelton | 313/336 |
| 3,840,955 | 10/1974 | Hagwood et al. | 29/25.18 |
| 3,859,550 | 1/1975 | Hagwood et al. | 313/309 |

*Primary Examiner*—Alfred E. Smith

*Assistant Examiner*—Charles F. Roberts

*Attorney, Agent, or Firm*—Nathan Edelberg; Robert P. Gibson; Freddie M. Bush

[57] ABSTRACT

The electron beam forming device uses a field effect electron emitter with a control electrode disposed on the surface thereof for field effect release of electrons. The control electrode can be shaped to produce a selective or segmented field for developing a particular current path. However, the shape of the beam is determined by the shape of the conductor of the backing plate which is external to tube housing instead of the internal control electrode. Thus multiple beams can be obtained from one emitting array and the final configuration of the device can be changed after the device is built.

7 Claims, 6 Drawing Figures

ELECTRON BEAM FORMING DEVICE

DEDICATORY CLAUSE

The invention described herein may be manufactured, used, and licensed by or for the Government for governmental purposes without the payment to me of any royalties thereon.

BACKGROUND OF THE INVENTION

Electron beams in electron tubes are formed using either thermionic or field emitters as an electron gun with a control grid or anode to form the electrons to the desired shape. The electron gun and anode produce a specified number of electrons at a specified velocity for use in electron tubes such as klystrons, traveling wave tubes, and television picture tubes. With thermionic emitters, electrons are boiled off the cathode and are accelerated toward the anode with an energy depending on the difference in potential between the anode and cathode. The majority of the electrons pass through a hole in the anode and into a drift space. With a potential applied across the drift space, the electron stream is deflected, being focused at a selected point on the screen. With no potential applied across the drift space, the electrons travel in a straight line and strike the screen at a selected or known place.

In modern electron tubes, the electron gun employs an electron emitter, an accelerating anode, and a focusing anode which concentrates the electron beam to enhance electron flow through the hole in the accelerating anode. This improves efficiency and eliminates heat related problems occurring when electrons strike the anode. The number of electrons in the electron beam must be constant and controllable, and the energy of all the electrons must be substantially the same for efficient operation. Small changes in emitter temperature result in changes in electron emission. Similarly, even small changes of anode voltage can affect the current. Therefore, anode potential and emitter temperature must be well regulated to provide constant current for proper operation of a thermionically controlled electron gun or electron beam forming device. A field effect electron gun and control electrode can control electron flow without thermionic emission or thermionic interference. U.S. Pat. No. 3,783,325 issued Jan. 1, 1974 to Joe Shelton discloses a field effect electron gun wherein the number of electrons emitted is a function of the electric field. The electric field which is developed between the emitter and the anode is controlled by the emitter and anode structure.

The usual approach to forming electron beams, using either thermionic or field emitters, is to use a gird to form the electrons to the desired shape. When multiple electron beams are required as for multiple beam cathode ray tubes, several individual emitting sources and control electrodes are required. This approach leads to problems due to electrons being intercepted by the grid resulting in grid heating and excessive grid current.

SUMMARY OF THE INVENTION

The electron beam forming device comprises a field effect electron emitter with an accelerating anode or control anode deposited on the emitting surface thereof. The field effect electron emitter is an oxide-metal matrix which comprises ordered metal fibers separated by insulating oxide. The metal fibers are more than a million and may be several million emitting fibers arranged in parallel for each square centimeter of surface area with the ends of the fibers forming the emitter surface. The distance between adjacent fiber ends is substantially the same and the fiber ends are all of substantially the same diameter. The non-emitting or back surface of the oxide-metal matrix has selected portions thereof in contact with a conductive backing plate to control the shape of the beam emitting from the emitting surface thereof. Thus the shape of the beam is determined by the shape of an external conductor instead of the internal control grid of the device and multiple beams can be obtained from one emitting array.

DESCRIPTION OF THE PREFERRED EMBODIMENT

Various techniques exist in the prior art for the production of conventional electron beams using thermionic and field effect emitters. These techniques deal with the use of shaped grids and are limited in the number of configurations possible, being essentially limited to solid and hollow beams generally shaped by the grid shape. The electron beam forming device, however, may use either a simple grid or a sectioned grid with the beam forming being accomplished by the emitter. This results in a simple, versatile device since the beam shape can be changed by external procedures after the device is constructed. Since the efficiency of many electronic devices is dictated to a large degree by electron beam shape, this ability to change the shape by external procedures after the device is constructed allows higher efficiency devices to be designed. The electron beam forming devices all use the low voltage field effect emitter composite, a conventional composite described in U.S. Pat. No. 3,745,402 issued July 10, 1973 to Joe Shelton, et al. The emitting point size, spacing, depth that emitting points are etched below the oxide surface, and grid-to-emitter spacing are controlled through routine manufacturing procedures to give the operating characteristics required for specific applications. For multi-beam operation the grid can be divided into sections for independent control of each separate beam.

Figure 1:
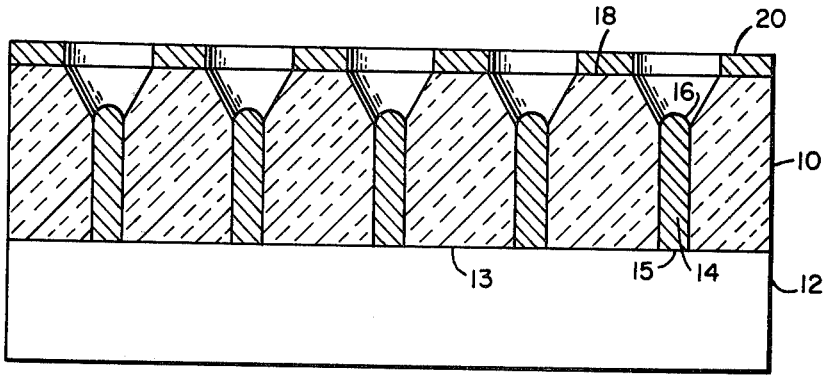
FIG. 1 is a low voltage field effect electron emitter with a conductive backing plate.

Referring now to the drawings wherein like numbers represent like parts in the several figures, FIG. 1 is typical of an emitter metal-oxide composite 10 coupled to a backing plate 12 which may be completely conductive or conductive only in sections therethrough for controlling the emitting fibers which are to receive electrical stimulation. Emitting fibers or rods 14 are shown with the emitting ends 16 thereof recessed below the surface 18 of composite 10. A conductive control anode 20 (grid or accelerating electrode) is deposited on the surface 18 of the composite oxide 13 with openings therethrough directly above the emitting tips 16 of the emitting rods 14. The etching of the emitting rods to a desired level below the surface of the oxide and the plating of the grid 20 on the surface of the oxide may be accomplished by well established chemical etching or ion milling processes to provide the desired separation between the plane of the surface of oxide 18 and the plane of the emitting tips 16 as well as providing the conical milling angle for the oxide.

Figure 2:
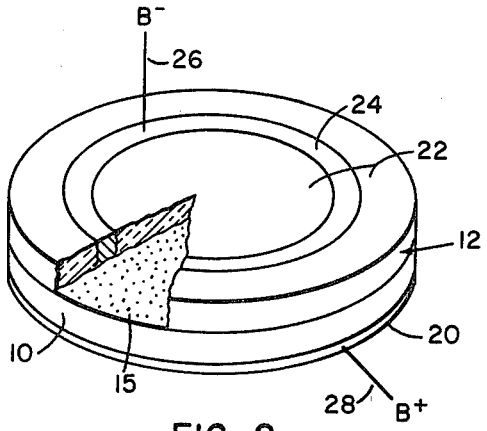
FIG. 2 is a diagrammatic view, partially cut away, of an emitter with backing plate adapted for hollow beam emission.

FIG. 2 shows the structure of an electron beam forming device for providing a simple beam such as a hollow beam. Backing plate 12 is shown deposited on the rear surface of composite 10 and adapted for emitting a cylindrical beam of electrons. Backing plate 12 comprises an insulating portion 22 on either side and supportive of a conductive ring of material 24. Conductive ring 24 supplys electrical power to the emitting ends 15 as may be typically supplied through an input lead 26. Grid or accelerating anode power would be coupled to anode 20 through an input lead 28. Since emission at the field emitter composite can occur only where the emitting ends or rods contact the conductor 24 of backing plate 12, the electrons are in the shape of a hollow beam when emitted. Since only those rods which are contacted by the conductor and the backing plate are capable of transmitting electrons there is sharp definition of the edges of the beam resulting in improved efficiency for devices such as traveling wave tubes. Since there is no electron cloud present at the emitter the beam is much better defined that hollow beams produced by thermionic emission.

Figure 3:
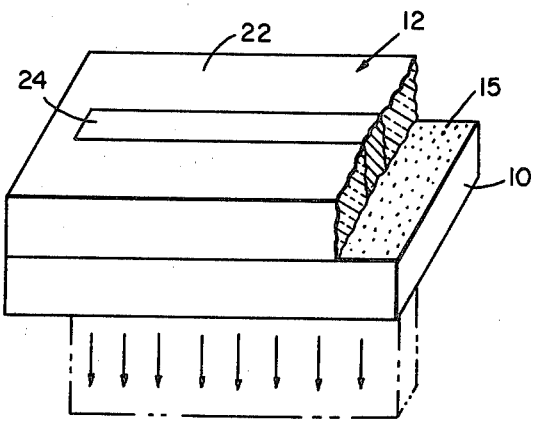
FIG. 3 is a perspective view, partially cut away, of an emitter with the backing plate adapted to provide sheet emission.

FIG. 3 shows a typical structure adapted for providing a sheet beam electron emission. Conductor 24 is rectangular in shape, being of appropriate length and width to provide the desired thickness and length of electron beam emission. Insulator 22, again surrounds and supports conductor 24 and protects and insulates that portion of the emitter and emitting ends 15 of rods 14 not contacted by conductor 24. This particular structure provides a well defined sheet beam for special tubes such as the carcinotron. Other electron beam shapes and sizes can be produced by using different shapes of conductor 24 deposited on the back side of the emitter deposit. This beam shape can be determined after the construction of the device since this type of operation is external to any vacuum envelope necessary or desired for the emitting region.

Figure 4:
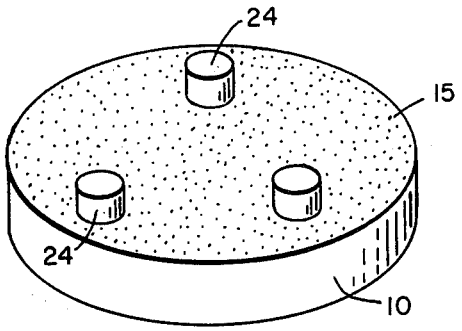
FIG. 4 is a perspective view of the field effect emitter with conductive posts selectively placed on the back of the emitter composite.
Figure 5:
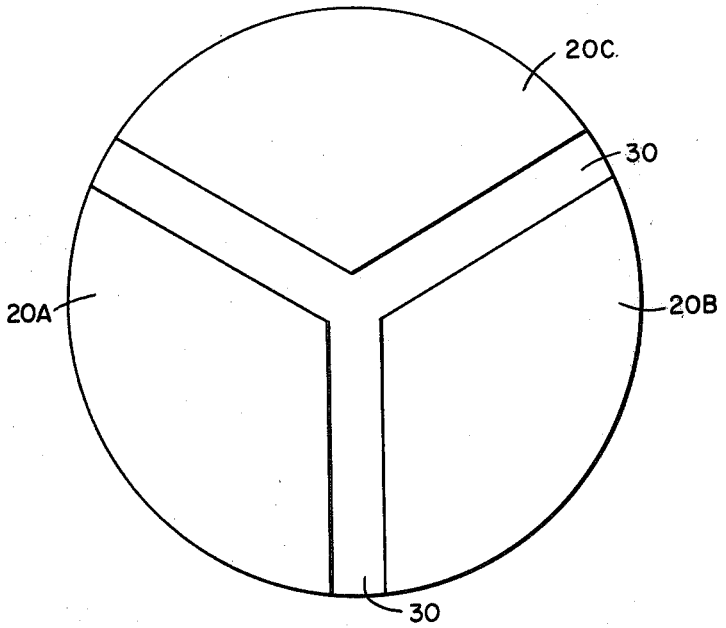
FIG. 5 is a segmented view of a grid or accelerating anode.

FIG. 4 shows a composite 10 adapted for providing multiple beams. This is done by placing several separate and distinct conductors 24 on the back plate or surface of the composite. The current density of each beam can be controlled and varied by changing the potential of the particular conducting area involved. Additional beam variation or control can be provided by sectioning the grid 20 as shown in FIG. 5. This particular construction is accomplished prior to placing the device within a vacuum envelope so that the particular grid structure is fixed. Typically, as shown in FIG. 5 grid 20 is sectioned into three sections 20A, 20B, and 20C, which may be readily accomplished by etching or machining. Selected conducting areas for the backing plate are then selected to lie immediately behind a section of grid which results in a number of controlled electron beams from one device, control of the beam is effected by both the desired grid 20 potential and the emitter backing plate potential.

Figure 6:
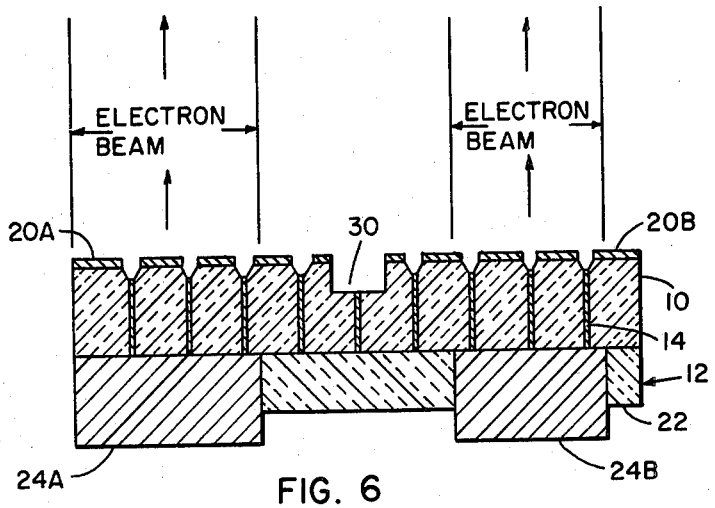
FIG. 6 is a diagrammatic view, in section, of an emitter composite with selected conductive posts coinciding with respecting segments of the accelerating grid.

FIG. 6 incorporates the grid structure of FIG. 5 and the selective conductor structure of FIG. 4 for providing more than one controlled electron beam from a single device. As shown in FIG. 6 backing plate 12 is composed of an insulator 22 and two or more selectively placed conductors 24A and 24B for making electrical connection with emitter composite 10 fibers 14. Grid segments 20A and 20B are shown deposited on the surface of the emitter with an insulating space 30 etched or machined into the surface of the emitter, separating the grids. With appropriate potentials applied between the conductive surfaces 24 and the conductive grids 20, separate and distinct electron beams are emitted. These beams are sharply defined by the particular shape of the conductors 24 on the backing plate. The number of beams generated is limited only by the limitations on the sectioning of the grid surface and the deposition or installing of corresponding conductive areas on the backing plate. In all cases the shape of the beam is determined by the shape of the external conductor instead of the internal grid. Multiple beams can be obtained from one emitting array. Since the conducting backing plate 12 can obviously be left external to any vacuum chamber encompassing the emitting surface of the oxide emitter the final configuration can be changed after the device is built.

In addition to the advantages associated with being able to form numerous electron beams from a common emitter such as for a complex electronic displays, the electron beam forming device has the advantage of being able to produce each beam at a predetermined intensity. For example, a screen such as a television face plate can be used to display the electron beams and the input to each segment can be adjusted to show visual maps with high resolution and areas of interest shown in a brighter display than surrounding areas.

Related electron emission devices are disclosed in a co-pending application entitled "Tubistor" by Joe Shelton. This co-pending application having Ser. No. 864,349 and filing date of Dec. 27, 1977 was filed simultaneously with applicant's application and licensed to the U.S. Government as represented by the Department of Army.

It is to be understood that the form of the invention shown and described is to be taken as preferred examples of the same, and that various changes in the arrangement of parts may be resorted to, without departing from the spirit or scope of the invention. Accordingly, the scope of the invention is to be limited only by the claims appended hereto.

I claim:

1. An electron beam forming device for use in electron tubes, comprising a field effect electron emitter having first and second parallel surfaces, said first surface being a planar emitting surface for emitting electrons therefrom, said emitter having at least a million emitting fibers per square centimeter of emitting surface, said fibers being disposed in parallel; an insulating oxide matrix encompassing, supporting, and separating said fibers, respective first ends of said fibers terminating in said emitting surface below the surface plane of said oxide matrix; an accelerating electrode deposited on the surface plane of said oxide matrix in a plane substantially parallel with said surface plane for enhancing electron flow from said emitter; and a backing plate disposed on the second surface of said emitter adjoining respective second ends of said emitting fibers, said backing plate having selected conductor portions thereof for conducting an electrical potential to selective ones of said emitting fibers and thereby providing a selectively shaped electron beam when said accelerating electrode and said conductor portions are subjected to an electric field.

2. An electron beam forming device as set forth in claim 1 wherein said backing plate comprises at least one electrical conductor portion coupled to a portion of said emitting fibers and having a predetermined geometric shape for stimulating electron emission from said fibers in the pattern of said shape, the other portion of said backing plate being an insulator for protecting the remainder of said emitting fiber ends and supporting said conductor.

3. An electron beam forming device as set forth in claim 2 wherein said conductor portion of said backing plate is in the shape of a ring for stimulating said field effect electron emitter to emit a hollow electron beam when subjected to an electric field.

4. An electron beam forming device as set forth in claim 2 wherein said conductor portion and said backing plate is in the shape of a straight bar for stimulating said emitter to emit a sheet of electrons when subjected to an electric field.

5. An electron beam forming device as set forth in claim 1 wherein said backing plate is comprised of a plurality of electrical conductors embedded in an insulating medium, each of said conductors being adapted for selectively coupling to emitting rods for providing a plurality of electron beams from said emitter when subjected to an electric field.

6. An electron beam forming device as set forth in claim 1 wherein said accelerating electrode is segmented into plural accelerating anode elements for providing separate and distinct accelerating potentials across the surface of said field effect emitter.

7. An electron beam forming device as set forth in claim 6 wherein said backing plate comprises a plurality of conductors supported by an insulator, said conductors contacting selected portions of said field effect emitter, respective ones of said conductors being positioned with respect to said plural accelerating anodes for providing separate and distinct plural electron beams within a single device when subjected to respective electric fields.

* * * * *